US011530537B2

(12) United States Patent
Stessel

(10) Patent No.: US 11,530,537 B2
(45) Date of Patent: Dec. 20, 2022

(54) SUSPENSION SYSTEM

(71) Applicant: ROCKWOOL International A/S, Hedehusene (DK)

(72) Inventor: Wilfried Stessel, Ranst (BE)

(73) Assignee: ROCKWOOL INTERNATIONAL A/S, Hedehusense (DK)

( * ) Notice: Subject to any disclaimer, the term of this patent is extended or adjusted under 35 U.S.C. 154(b) by 0 days.

(21) Appl. No.: 16/764,752

(22) PCT Filed: Nov. 14, 2018

(86) PCT No.: PCT/IB2018/058957

§ 371 (c)(1),
(2) Date: May 15, 2020

(87) PCT Pub. No.: WO2019/097421

PCT Pub. Date: May 23, 2019

(65) Prior Publication Data

US 2021/0180330 A1 Jun. 17, 2021

(30) Foreign Application Priority Data

Nov. 17, 2017 (EP) ..... 17202436.6

(51) Int. Cl.
*E04F 13/08* (2006.01)
*E04F 19/06* (2006.01)

(52) U.S. Cl.
CPC ..... *E04F 13/0816* (2013.01); *E04F 13/083* (2013.01); *E04F 13/0867* (2013.01); *E04F 19/06* (2013.01)

(58) Field of Classification Search
CPC ..... E04F 13/0816; E04F 13/0867; E04F 13/0805; E04F 13/083; E04F 13/0819; E04F 19/06
See application file for complete search history.

(56) References Cited

U.S. PATENT DOCUMENTS 1,908,200 A * 5/1933 Chilion ..... A47G 1/1686 248/495
1,939,809 A 12/1933 Gorman
(Continued)

FOREIGN PATENT DOCUMENTS

CA 3027022 A1 * 12/2017 ..... E04F 13/083
CN 101603359 A 12/2009
(Continued)

OTHER PUBLICATIONS

International Search Report dated Feb. 26, 2019 for corresponding International Application No. PCT/IB2018/058957.

*Primary Examiner* — Jessie T Fonseca
(74) *Attorney, Agent, or Firm* — Tarolli, Sundheim, Covell & Tummino LLP

(57) ABSTRACT

A sound absorbing system comprising: A wall (5); A wall bracket (1) that is affixed to the wall, the wall bracket comprising a fixing plate (6) which is affixed to and lies along the wall surface; a spacer element (7) connected to and projecting from the fixing plate so as to extend away from the wall and a support element (8) connected to the spacer element; A panel bracket (2) comprising a hook element (11) arranged to hang on the support element of the wall bracket and at least one barb (12) connected to the hook element and extending away from the wall And an acoustic panel (4) affixed to the panel bracket by means of the at least one barb penetrating the panel; such that the acoustic panel is positioned spaced away from the wall at a distance X from the wall and generally parallel to the wall.

19 Claims, 8 Drawing Sheets

(56) References Cited

U.S. PATENT DOCUMENTS

| | | | | | |
|---|---|---|---|---|---|
| 2,395,726 | A * | 2/1946 | Del Tufo | E04F 13/0839 | 52/509 |
| 3,507,082 | A * | 4/1970 | Heirich | E04F 13/0805 | 52/506.09 |
| 3,621,635 | A * | 11/1971 | De Lange | E04F 13/083 | 52/235 |
| 4,621,473 | A | 11/1986 | Wendt | | |
| 5,155,958 | A * | 10/1992 | Huff | E04F 13/0826 | 52/204.593 |
| 5,398,473 | A * | 3/1995 | Chan | E04F 13/0812 | 52/235 |
| 8,474,193 | B2 | 7/2013 | Sutton | | |
| 9,181,711 | B2 * | 11/2015 | Bordener | E04F 13/0816 | |
| 9,347,225 | B2 * | 5/2016 | Glancy | E04F 13/0842 | |
| 9,469,999 | B1 * | 10/2016 | Aboukhalil | E04F 13/0817 | |
| 9,574,345 | B2 * | 2/2017 | Duranleau | E04F 13/25 | |
| 9,650,789 | B2 * | 5/2017 | Gulnick | E04F 13/0801 | |
| 9,650,790 | B2 * | 5/2017 | Bordener | E04F 13/0803 | |
| 9,708,817 | B2 * | 7/2017 | Gestetner | E04F 13/083 | |
| 9,976,311 | B2 * | 5/2018 | Gulnick | F16M 13/02 | |
| 10,041,256 | B2 * | 8/2018 | Scully | E04F 13/083 | |
| 10,640,988 | B2 * | 5/2020 | Bitsch | E04F 13/0819 | |
| 2009/0283359 | A1 * | 11/2009 | Ravnaas | E04B 9/001 | 181/286 |
| 2011/0047916 | A1 * | 3/2011 | Muller | E04F 13/0819 | 52/477 |
| 2011/0260129 | A1 * | 10/2011 | Schopf | E04H 17/168 | 256/24 |
| 2011/0283632 | A1 | 11/2011 | Sutton | | |
| 2012/0186170 | A1 * | 7/2012 | Macdonald | E04F 13/083 | 52/173.3 |
| 2012/0304573 | A1 * | 12/2012 | Aboukhalil | E04F 13/0816 | 52/506.05 |
| 2013/0048812 | A1 * | 2/2013 | Lozano | H05K 5/0204 | 248/220.22 |
| 2013/0183088 | A1 * | 7/2013 | Wilkinson, Jr. | E04F 13/0875 | 403/354 |
| 2013/0205698 | A1 * | 8/2013 | Todd | E04F 13/083 | 52/302.1 |
| 2013/0269276 | A1 * | 10/2013 | Gaynor | E04F 13/083 | 52/506.05 |
| 2014/0196399 | A1 * | 7/2014 | Egri, II | E04B 1/94 | 52/704 |
| 2015/0197940 | A1 | 7/2015 | Bilge | | |
| 2016/0106214 | A1 * | 4/2016 | Hagen | F16M 13/02 | 361/679.21 |
| 2017/0226747 | A1 | 8/2017 | Fernandez | | |

FOREIGN PATENT DOCUMENTS

| | | | | |
|---|---|---|---|---|
| CN | 203654497 | U | 6/2014 | |
| CN | 105814884 | A | 7/2016 | |
| CN | 205663132 | U | 10/2016 | |
| CN | 207620267 | U | 7/2018 | |
| DE | 102007008829 | A1 * | 8/2008 | E04F 13/083 |
| EP | 0337570 | A1 | 10/1989 | |
| EP | 1205612 | A2 * | 5/2002 | E04F 13/06 |
| EP | 1793057 | A2 | 6/2007 | |
| FR | 2797901 | A1 * | 3/2001 | E04F 13/0826 |
| RU | 2253695 | C1 | 6/2015 | |
| WO | 8500397 | A | 1/1985 | |
| WO | WO-2010149623 | A1 * | 12/2010 | E04F 13/0817 |

* cited by examiner

SUSPENSION SYSTEM

RELATED APPLICATIONS

The present application is a U.S. National Stage application under 35 USC 371 of PCT Application Serial No. PCT/IB2018/058957, filed on 14 Nov. 2018; which claims priority from EP Patent Application No. 17202436.6, filed 17 Nov. 2017, the entirety of both of which are incorporated herein by reference.

The present invention relates to systems for suspending acoustic panels on walls, and to brackets for use in such systems, as well as methods for suspending such acoustic panels.

It is well known to provide acoustic panels for formation of suspended ceilings. Such acoustic panels are well known and may be based on acoustic insulation materials such as man-made vitreous fibre (MMVF), for instance stone fibres or glass fibres. They may also be formed of wood fibre or gypsum.

It can be desirable to position such acoustic panels so that they are affixed to a vertical wall rather than as a suspended ceiling. This may be desirable for aesthetic or acoustic reasons.

However, application of acoustic panels to vertical walls is a complex and time-consuming process. It is difficult for installers to position the panels accurately. It can also be desirable, either for aesthetic or acoustic purposes, to have the panels spaced a small distance away from the wall. In such a case it can also be desirable to obtain overlaps between panels which are spaced at different distances from the wall. Again, installation in this configuration is complex and time-consuming.

The present invention provides a system which allows affixation of acoustic panels to a wall by means of a bracket system which is straightforward to use and to implement.

U.S. Pat. No. 4,621,473A discloses an integral clip for attaching wall panels to metal studs.

EP 1 793 057 A discloses a doubling profile having an essentially L-shaped cross section, a mounting web and a panelling flange, which at least approximately enclose a right angle with one another, complementing one another to form the L-shaped cross section in question.

US 2017/226747 A1 discloses a ventilated façade comprising horizontal rails and covering pieces mounted on the horizontal rails by anchoring elements.

U.S. Pat. No. 1,939,809 discloses mounting means for acoustic wall and ceiling tiles.

EP 0 337 570 A discloses a system for blind fastening of wall panels in a detachable manner.

According to the invention we provide a sound absorbing system comprising:

(a) a wall;

(b) a wall bracket that is affixed to the wall, the wall bracket comprising:

(i) a fixing plate which is affixed to and lies along the wall surface;

(ii) a spacer element connected to and projecting from the fixing plate so as to extend away from the wall;

(iii) a support element connected to the spacer element;

(c) a panel bracket comprising:

(iv) a hook element arranged to hang on the support element of the wall bracket;

and (v) at least one barb connected to the hook element and extending away from the wall;

(d) an acoustic panel affixed to the panel bracket by means of the at least one barb penetrating the panel;

such that the acoustic panel is positioned spaced away from the wall at a distance X from the wall and generally parallel to the wall.

The system of the invention has multiple advantages.

The distance X defines the distance of the acoustic panel from the wall. An advantage of the system is that multiple wall brackets of the same overall structure can be made using a single manufacturing process but with differing dimensions of the spacer element, leading to different distances X. Accordingly, it is possible to use multiple wall brackets to affix different panels to a single wall at different distances X. This facilitates overlap if required.

A further advantage is ease of application. In order to attach the acoustic panel to the wall the installer needs only to affix the wall bracket to the wall and separately affix the panel bracket to the panel by means of penetration of the barbs into the panel and can then easily hang the panel bracket on the hook element of the wall bracket. No additional fixings are required. One reason for this is that the weight of the acoustic panel is sufficient to provide stability to the connection of the panel bracket with the wall bracket.

According to the invention we also provide a method of mounting an acoustic panel on a wall, the method comprising:

providing a wall bracket comprising: a fixing plate which has at least two apertures; a spacer element connected to and projecting from the fixing plate;

and a support element connected to the spacer element;

affixing the wall bracket to the wall by means of fasteners which pass through the apertures, such that the fixing plate lies along the wall surface and the spacer element extends in a direction away from the wall;

providing an acoustic panel;

providing a panel bracket comprising: a hook element and at least one barb connected to the hook element;

affixing the acoustic panel to the panel bracket by penetration of the at least one barb into the material of the acoustic panel;

hanging the panel bracket with affixed acoustic panel on the support element of the wall bracket by means of hanging the hook element on the support element.

Further according to the invention we provide a kit comprising (A) at least two wall brackets as defined above, wherein the distances X provided by the at least two wall brackets are different, and (B) at least one, preferably at least two, panel brackets.

The system of the invention allows the arrangement of acoustic panels on a wall. Generally this is an internal wall. Usually the wall will be a substantially vertical wall. As is conventional, the wall will normally be supplied with a rendering suitable for an internal wall.

The purpose of the fixing plate is to affix the wall bracket to the wall. The wall bracket is affixed to the wall by means of the fixing plate. The fixing plate lies along the surface of the wall. Thus the plane of the fixing plate is substantially parallel to the surface of the wall.

In general the fixing plate has a substantially rectangular perimeter. Preferably it has two opposed long edges and two opposed short edges. Preferably the plate will be affixed to the wall such that the long edges are substantially horizontal and the short edges are substantially vertical.

Dimensions can be chosen according to the requirements of the acoustic panel to be mounted on the wall. However, the length (long edges) of the fixing plate can be in the range 300 to 600 mm and the height (short edges) can be in the range 35 to 75 mm. Generally a length shorter than 300 mm would be too short for adequate stability for panels of conventional size, whereas a length greater than 600 mm would make the bracket visible behind panels of conventional size. A height of less than 35 mm would generally make it difficult to fix the bracket to the wall, and generally a height of more than 75 mm would be in excess and waste of material.

The fixing plate is affixed to the wall, preferably by means of fasteners which pass through apertures provided in the fixing plate. At least two fasteners are usually used, preferably at least three. The fixing plate is provided with at least two, preferably at least three apertures, although more apertures than fasteners may be provided, to provide flexibility for the installer. Different types of apertures may be provided to allow for different types of fasteners to be used, e.g. dependent on the type of material from which the surface of the wall is formed. Further the shape of the apertures may differ to allow for positional adjustment, e.g. by providing elongated apertures.

The fixing plate may comprise only apertures which are adapted for application of fasteners or it may comprise further cut-outs, for instance for weight reduction or material reduction reasons.

Connected to and projecting from the fixing plate is a spacer element which extends in a direction away from the wall. The purpose of the spacer element is to provide a distance between the wall and the support element on which the panel bracket is to be hung.

Preferably the spacer element is a plate but can also be provided with cut-outs for material reduction and weight reduction purposes. Preferably the spacer element has a substantially rectangular perimeter. Preferably it has two opposed long edges and two opposed short edges.

Dimensions of the spacer element can be chosen according to the requirements of the acoustic panel to be mounted on the wall. However, the length (long edges) of the spacer element can be in the range 300 to 600 mm.

The spacer element is preferably connected with the fixing plate along one of its long edges. The spacer element and fixing plate preferably are of substantially the same length. Preferably also the fixing plate and spacer element are formed from a single piece of material. In practice the fixing plate and spacer element preferably take the form of an L profile in cross section.

The spacer element extends away from the wall and its plane is preferably substantially perpendicular to the surface of the wall but may vary by for instance 1 to 20 degrees from perpendicular with the wall. The angle between the wall and the plane of the spacer element is preferably in the range of 89 to 30 degrees. If the spacer element is not perpendicular with the wall then preferably it extends upwardly from the horizontal rather than downwardly.

Also part of the wall bracket is a support element connected to the spacer element. The purpose of the support element is to allow hanging of the panel bracket on the wall bracket. Due to the presence of the spacer element the support element is spaced away from the wall.

The support element is configured so that a hook element of the panel bracket can be arranged to hang on it. Preferably the support element is a further plate which extends upwardly from the edge of the spacer element that is distal from the wall. As with the fixing plate and the spacer element, the support element is preferably integral with the spacer element and formed from the same sheet of material.

The support element is preferably in the form of a plate. It is preferably coextensive along its length with the spacer element. The plate preferably extends upwardly. The angle of the plate with the surface of the wall is preferably in the range 0 to 70 degrees, where an angle of 30 to 45 degrees with the surface of the wall is most preferred in order to have a good fit and low risk of clearance.

Dimensions of the support element can be chosen according to the requirements of the acoustic panel to be mounted on the wall. However, the length (long edges) of the support element can be in the range 300 to 600 mm.

The plate itself may comprise a fold. Preferably it comprises a fold along its length. The fold preferably provides a ridge which constitutes the uppermost point of the support element, on which the hook element of the panel bracket rests.

The panel bracket hangs on the support element of the wall bracket. Namely, the weight of the panel bracket is supported by the wall bracket. The panel bracket itself supports the acoustic panel by means of at least one barb.

Accordingly the panel bracket comprises at least one hook element arranged to hang on the support element of the wall bracket. The hook element may comprise a series of hooks but is preferably in the form of a single curved or, more preferably, folded hook plate.

Preferably the hook plate is substantially coextensive with the length of the support element. Preferably it is a little shorter than the support element, e.g. 20 to 35 mm, for instance about 30 mm, shorter, to allow the installer to easily mount the hook plate on the support element.

Dimensions of the hook element can be chosen according to the requirements of the acoustic panel to be mounted on the wall. However, the length (long edges) of the hook element can be in the range 270 to 570 mm.

In preferred cases the support element of the wall bracket comprises stop members at each end. The hook element of the panel bracket fits between the two stop members and the stop members function to prevent relative lateral movement between the wall bracket and the panel bracket. An advantage of the hook plate being a little shorter than the support element is that the installer will be able to slide the hook plate to each end stop and thereby know that the hook element is correctly mounted on the support element.

The panel bracket comprises a hook element which is preferably a folded plate. The hook element is configured so that when installed it will provide a barb plate whose plane is substantially vertical. From this substantially vertical plane extends at least one barb. Preferably there are at least two barbs and there can be more. The barbs extend from the hook element, in a direction away from the wall and generally extend upwardly. The angle between the plane of the barbs and the wall is preferably in the range 20 to 50 degrees, and preferably 45 degrees±5 degrees. The precise angle will be chosen as appropriate depending on the material, weight and density of the panels.

The acoustic panel is supported by means of impalement on the barb(s), so that the barb(s) penetrate(s) the material of the acoustic panel. This means of affixation has the advantage that the only fixing step that involves applying fasteners and that must be carried out by the installer is the fastening of the wall bracket to the wall. Thus the provision of the system is straightforward and not complex.

For fixing the panel bracket to the panel, the barbs are pressed into the material of the panel. Generally they are pressed in as far as is possible so that substantially the full length of each barb is within the panel material. The extent of penetration is limited by the barb plate. Once the panel has been impaled on the barbs then the barb plate should lie along the surface of the panel and generally be contiguous with it. Thus the barb plate and the panel are substantially parallel with the wall surface.

The panel bracket may comprise apertures in the barb plate to provide the option of using fasteners for additional security of the connection between the panel and the panel bracket. However, an advantage of the invention is that such fastenings are not often necessary.

The wall bracket may preferably also include a stabilisation member. This extends downwardly from the edge of the spacer element that is distal from the wall. It is preferably in the form of a plate and is preferably substantially parallel to the wall. When the panel bracket and panel have been positioned on the support element the barb plate of the panel bracket can bear against the stabilisation element so as to reduce the possibility of rotation about the axis along the connecting point between the support element and the hook element.

If present, the stabilisation member has a height in the range 20 mm to 40 mm, such as about 31.5 mm. The height is the distance from the lowermost edge to the edge which is uppermost and in contact with the support element. A stabilisation member of greater height can provide greater stabilisation but if the height is excessive then this can reduce the ease of installation.

Preferably the wall bracket and the panel bracket are made of metal, more preferably steel, such as galvanized steel, aluminium, such as extruded or roll formed, or copper. Alternatively plastics, such as fibre reinforced plastics for improved strength, may be used.

Preferably the wall bracket and the panel bracket are each unitary elements. Preferably each is formed from a single sheet of material, preferably metal. Formation can be by punching or shearing. An advantage of the invention lies in the fact that the structures of the brackets can each be formed from a single sheet.

For further minimisation of rotational movement of the panel, and in particular rotational movement that might lead to movement of the lower end of the panel towards the wall, it is possible to use a distancing element which is pressed into a region of the panel on the same surface as the panel bracket but spatially separated from it.

The distancing element has tines which can penetrate the acoustic panel. These tines extend from a flange which limits penetration of the tines into the acoustic panel. Preferably there are at least two tines, and three has been found to be optimum in some circumstances, although more can be used if desirable.

Extending from the face of the flange opposed to that from which the tines extend is a spacer bolt, which may be adjusted in length by rotation of the spacer bolt relative to a nut positioned at the flange. In the suspension system of the invention the distance Y between the surface of the flange which is in contact with the panel and the end of the spacer bolt which is distal from that surface corresponds with the distance X, such that the position on the acoustic panel into which the spacer element is added is held at the same distance from the wall as the position at which the panel bracket is affixed. This distance can be adjusted and optimised by modifying the length of the spacer bolt.

More than one distancing element can be applied to a single panel, but generally a single distancing element provides sufficient stability.

The acoustic panel may be formed of any of the materials known for such panels. Examples are wood fibre, gypsum and MMVF, such as glass fibre, stone fibre and slag fibre, the fibrous or particulate material being bonded with a binder. MMVF acoustic panels are preferred. The panels may be provided with the conventional surface treatments, covering layers and so on that are known in the art. The material of the panels is such that it is possible without difficulty to impale the panel on the barbs and the connection is retained. It is also such that the tines of the distancing element, if used, are also able to be pressed without difficulty into the surface of the panel. A wide variety of dimensions and perimeter configurations of acoustic panels may be used. They may be rectangular, for instance, square; oval; circular or any other desired shape. One of the advantages of the invention is the ability to apply and mount acoustic panels of any shape.

The thickness of the acoustic panels is preferably in the range 30 mm to 50 mm. Generally a lower thickness would lead to a panel which is not robust and rigid enough, and higher thickness generally leads to excess weight.

The distance X which defines the spacing of the acoustic panel from the wall is preferably in the range 10 mm to 75 mm, with examples being 65 mm and 15 mm. This spacing is determined by the configuration of the spacer element and the support element.

In general the weight of the acoustic panel is sufficient to retain a stable connection between the wall bracket and the panel bracket. However if necessary it is possible to provide a clip which provides an additional stabilisation of the connection between the two.

The system of the invention includes a wall and at least one panel affixed to the wall. It may include more than one panel affixed to a single wall, thus including corresponding numbers of wall brackets and panel brackets, because one wall bracket and one panel bracket are required to mount each panel. One advantageous system comprises at least two panels affixed to the wall, each panel being affixed by means of a wall bracket and panel bracket as described above, with the distance X being different for the two panels.

In one preferred embodiment of this system there is overlap between the two panels.

Such a system may include more than two panels, for instance at least four panels.

According to the invention it is also preferred to provide a distancing element which is affixed to the panel in a position at a region of the acoustic panel towards its lower end. This contributes towards stabilisation of the angle of the acoustic panel relative to the wall.

According to a further aspect of the invention there is provided a method of mounting an acoustic panel on a wall, the method comprising:

- providing a wall bracket comprising a fixing plate which has at least two apertures; a spacer element connected to and projecting from the fixing plate;
- and a support element connected to the spacer element;
- affixing the wall bracket to the wall by means of fasteners which pass through the apertures, such that the fixing plate lies along the wall surface and the spacer element extends in a direction away from the wall;
- providing an acoustic panel;
- providing a panel bracket comprising a hook element and at least one barb connected to the hook element;
- affixing the acoustic panel to the panel bracket by penetration of the at least one barb into the material of the acoustic panel;
- hanging the panel bracket with affixed acoustic panel on the support element of the wall bracket by means of hanging the hook element on the support element.

According to this method the step of affixing the wall bracket to the wall may be carried out before or after the step of affixing the acoustic panel to the panel bracket.

In the method of the invention the wall bracket may have any of the additional features discussed above for the wall bracket in the context of the system of the invention.

In the method of the invention the panel bracket may have any of the additional features discussed above for the panel bracket in the context of the system of the invention.

In the method of the invention, the wall and the panel, and the relationships between each of these and each of the brackets, may each independently have any of the additional features discussed above for the wall and the panel in the context of the system of the invention.

The invention provides a novel panel bracket. Thus in a further aspect of the invention there is provided a bracket for mounting an acoustic panel, the bracket comprising:

an elongate plate having first and second major surfaces and being of substantially rectangular perimeter having top and bottom long edges and short end edges, wherein the top and bottom long edges have length in the range 250 to 600 mm and the top and bottom long edges have length from 3 to 10 times the length of the end edges wherein the top edge is provided with a fold along substantially its entire length in the direction of the first major surface and the plate is provided with at least two barbs in the form of cut-outs extending upwardly in a direction away from the second major surface and forming an angle with the second major surface in the range 20 to 50 degrees.

Preferably the plate is provided with at least three, preferably four barbs.

Preferably the plate is provided with at least two apertures each adapted to receive a fastener.

Preferably the bracket is formed of metal, more preferably steel, such as galvanized steel, aluminium, such as extruded or roll formed, or copper. Alternatively plastics, such as fibre reinforced plastics for improved strength, may be used.

According to a yet further aspect of the invention there is provided a kit for use in affixing acoustic panels to a wall, comprising (A) at least two wall brackets as defined above, wherein the distances X provided by the at least two wall brackets are different, and (B) at least one, preferably at least two, panel brackets. Such a kit provides the constituents that allow an installer to install at least two panels at differing distances from a single wall, thus permitting overlap.

In this aspect of the invention the panel bracket and the wall brackets may have any of the features discussed above in the context of the system of the invention.

DETAILED DESCRIPTION OF THE DRAWINGS

Figure 1:
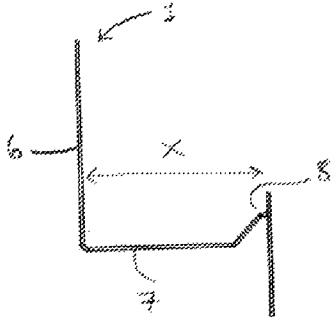
FIG. 1 shows a side view cross section of a wall bracket 1.

FIG. 1 shows a side cross section of a wall bracket 1 according to the invention. The fixing plate 6, the spacer element 7 and the support element 8 are formed integrally from a single sheet of steel.

Figure 2:
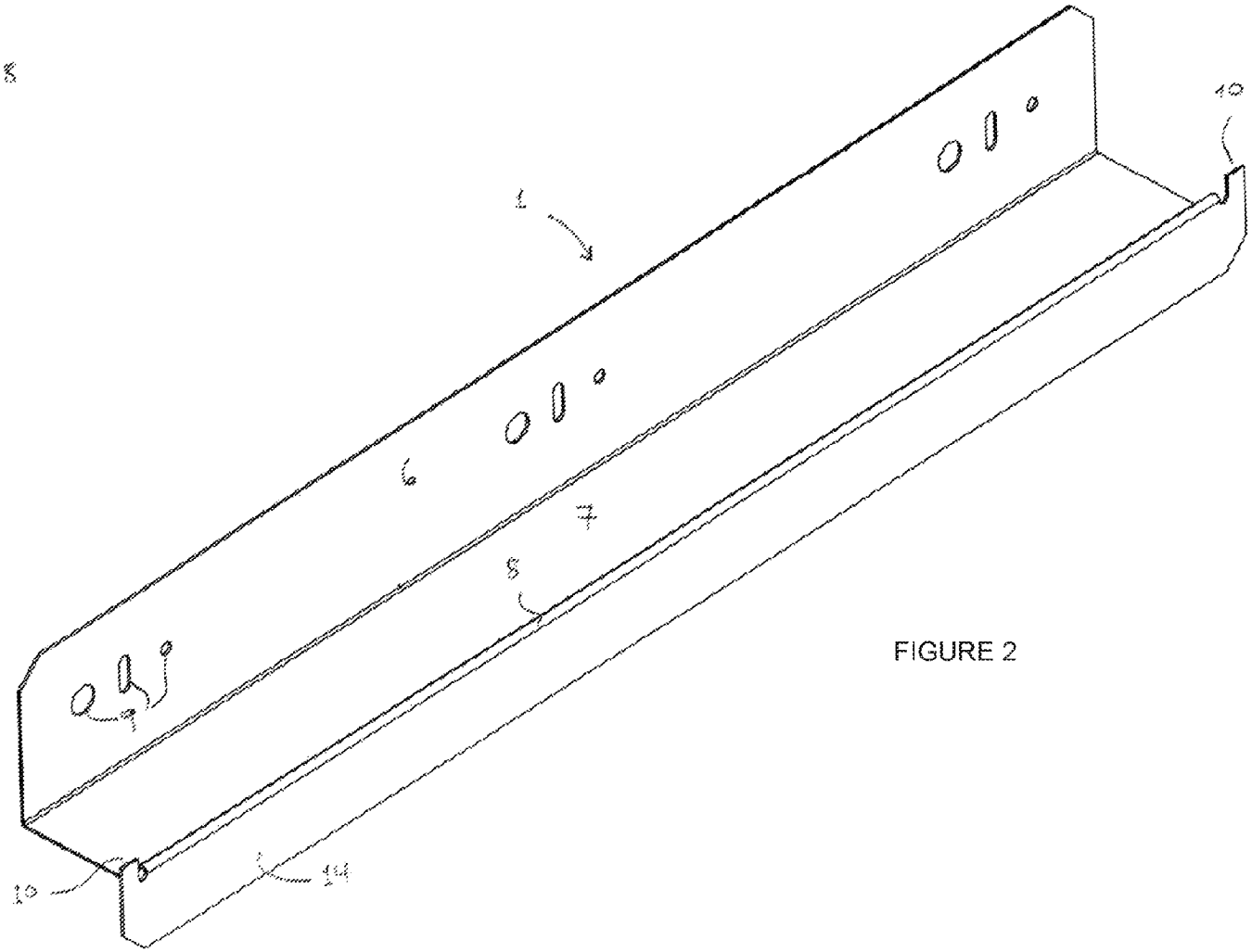
FIG. 2 shows a perspective view of the wall bracket 1 of FIG. 1.

When in use the fixing plate 6 is fixed to a wall by means of fasteners being passed through apertures 9. As shown in FIG. 2 the apertures may be provided in different configurations so that different fastener types may be used. In this embodiment, three fasteners are used to attach the fixing plate to a wall. Generally the fixing plate 6 lies along the surface of the wall so that on a vertical wall the plane of the fixing plate is vertical.

The wall bracket is generally elongate and is positioned on the wall so as to be substantially horizontal, i.e. the long edges of the fixing plate are substantially horizontal.

The fixing plate 6 has a substantially rectangular perimeter with two opposed long edges and two opposed short edges. The lower long edge connects with the spacer element 7 which is also in the form of a plate, and which extends substantially perpendicularly from the fixing plate, and hence in use is substantially perpendicular to the wall. The fixing plate and the spacer element form a substantially L shaped profile.

The spacer element is also substantially rectangular in perimeter and its long edges are substantially coextensive with the long edges of the fixing plate. The spacer element has one edge proximal to the wall and one edge distal to the wall. At its distal edge it connects with the support element 8.

This support element 8 extends upwardly from the distal edge of the spacer element so as to form a ridge on which the panel bracket can hang by means of its hook element.

The wall bracket is provided with stop elements 10 at each end of the support element 8. These extend upwardly at the ends of the support element 8.

Figure 6:
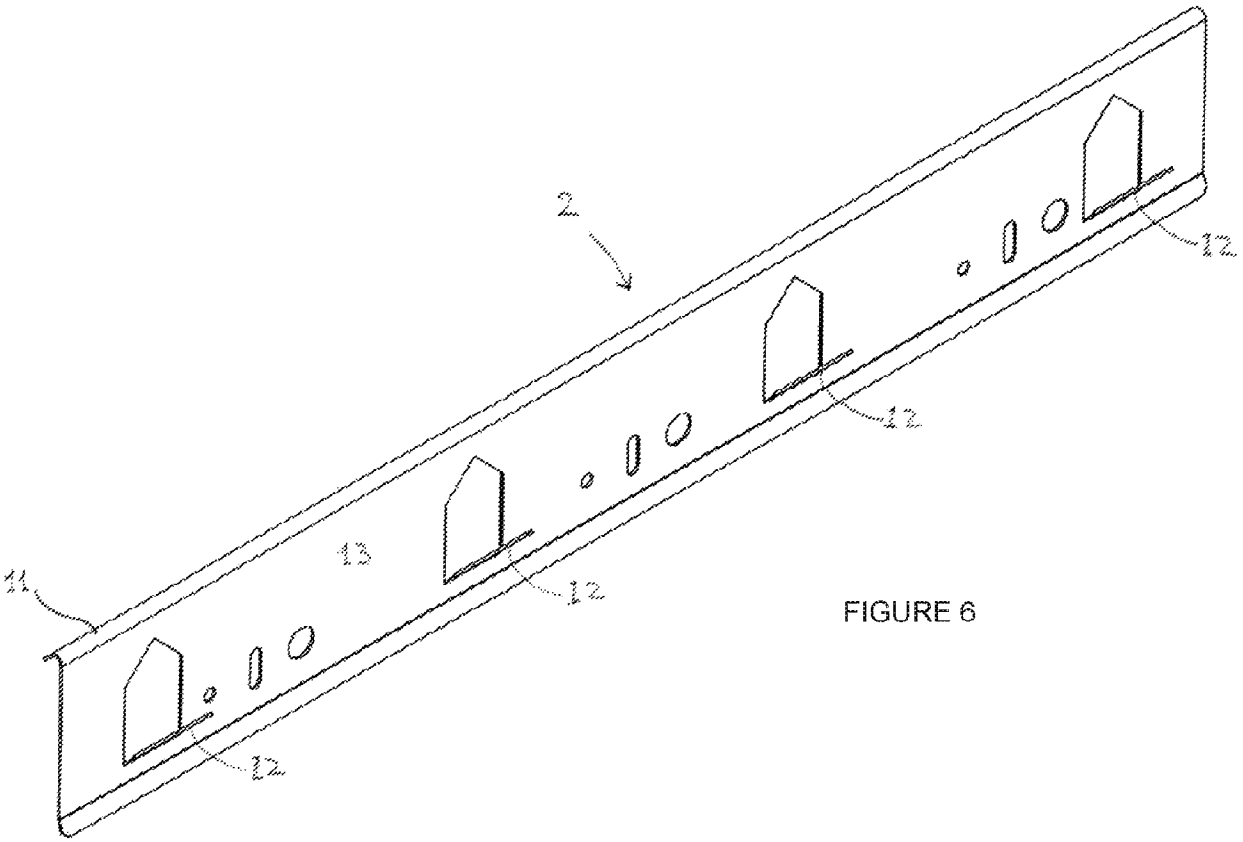
FIG. 6 shows a perspective view of the panel bracket of FIG. 5.
Figure 5:
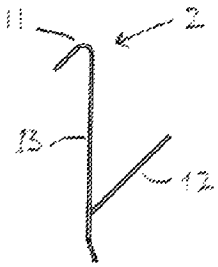
FIG. 5 shows a side view cross section of a panel bracket 2. This is useful in the system and method of the invention and is a panel bracket of the invention.

The panel bracket 2 comprises an elongate plate having first and second major surfaces. The hook element 11 of the panel bracket 2 shown in FIGS. 5 and 6 is provided by a fold in the direction of the first major surface, which is the surface that faces towards the wall bracket. The hook element hangs on the support element 8 in between the stop members 10. The stop members 10 prevent displacement of the panel bracket along the length of the wall bracket.

For mounting of an acoustic panel 4 the panel bracket 2 is affixed to the panel 4 by means of the barbs 12. These are formed by cut-outs in the hook element 11. The hook element 11 comprises an angled plate whereby the top part is configured so as to hook onto the support element of the wall bracket and a barb plate 13, which is vertical in use, is provided with barbs 12 which extend away from the second plate and upwardly relative to the horizontal.

The angle between the barbs 12 and the barb plate 13 of the hook element is desirably in the range 20 to 50 degrees, such as in the range 40 to 50 degrees, preferably near 45 degrees. This assists with ease of application of the panel bracket to the panel.

The panel bracket preferably contains at least two barbs, more preferably at least three and in this example there are four. In the method of mounting, the barbs are pressed into the panel and penetrate the panel material so as to affix the panel bracket to the panel. Substantially the whole length of each barb penetrates into the panel, with the barb plate acting as a stop to penetration. The barb plate 13 lies along the surface of the panel and is substantially contiguous with it. Thus it ensures that the angle of the barbs within the panel and relative to the surface of the panel is maintained.

For mounting the panel to the wall it is then simply necessary to hook the hook member onto the wall bracket. As well preventing lateral movement between the panel bracket and the wall bracket, the stop members also act as a guide for the installer in mounting the panel with attached panel bracket.

Figure 4:
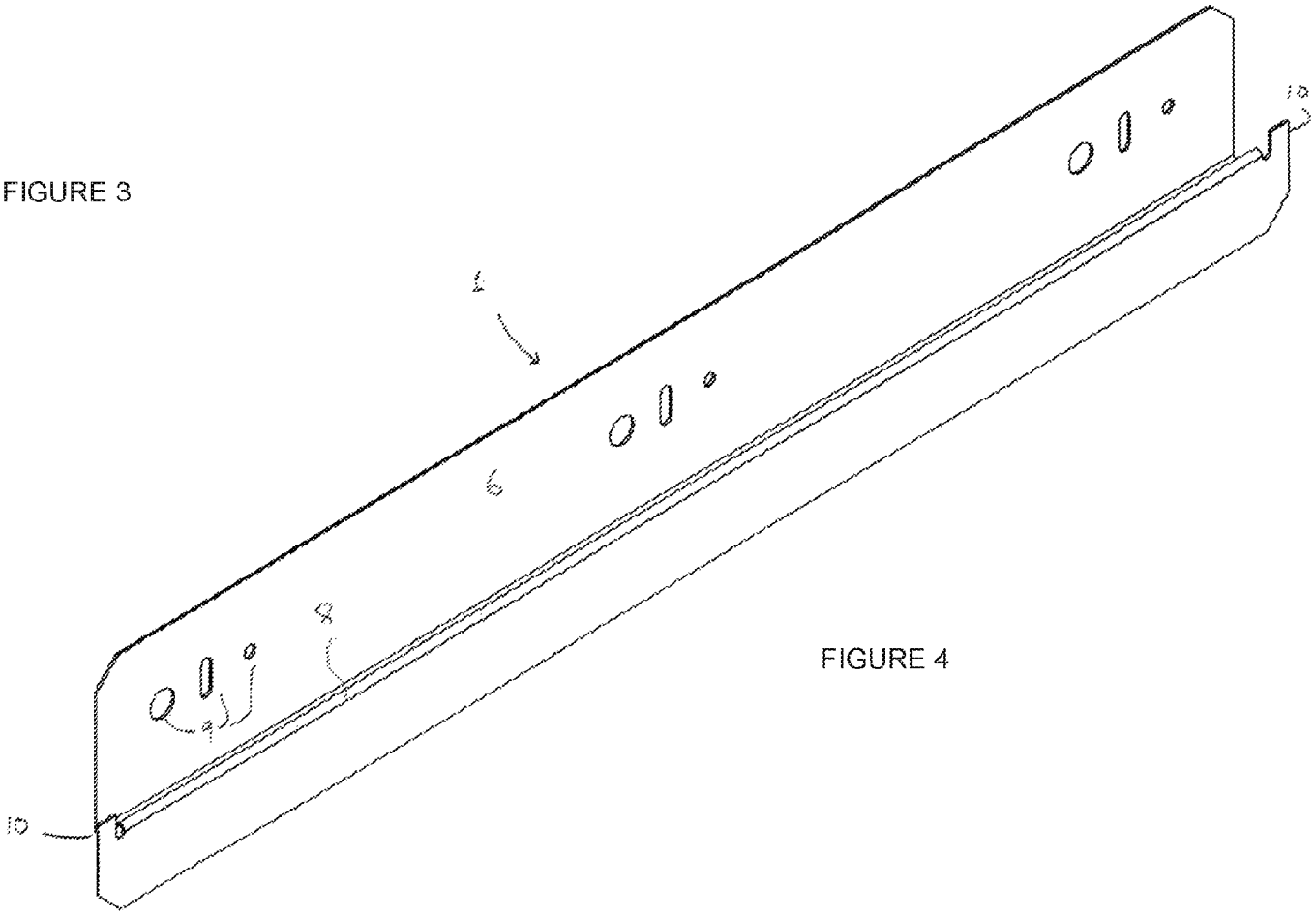
FIG. 4 shows a perspective view of the wall bracket of FIG. 3.
Figure 3:
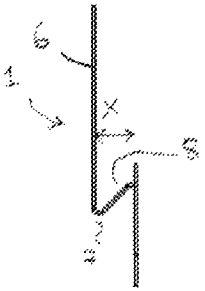
FIG. 3 shows a side view cross section of an alternative wall bracket 1.

The wall bracket shown in FIGS. 1 and 2 has a relatively large spacing Z between the fixing plate and the support element, so that the distance X between the panel and the surface of the wall is relatively high, in comparison with the wall bracket shown in FIGS. 3 and 4. In this latter embodiment the distance Z, and consequently, distance X, is relatively short. The spacer element 7 has a very short extent and the support element 8 provides a very short distance between the panel and the wall in use.

The wall bracket also includes a stabilisation member 14 which extends downwardly from the support element. Once the panel bracket is hooked onto the support element the barb plate 13 bears against the stabilisation member 14 so as to minimise rotational movement around the ridge of the support element.

Figure 8:
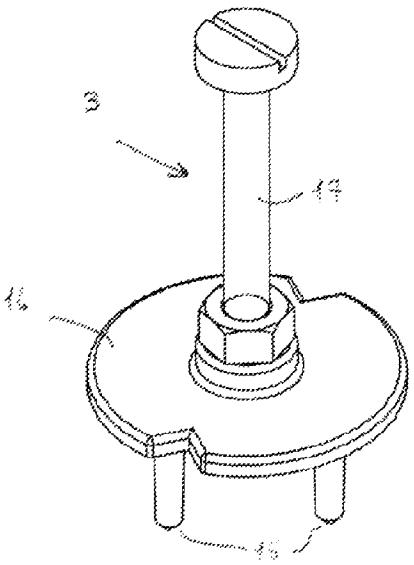
FIG. 8 shows a perspective view of the distancing element of FIG. 7.
Figure 7:
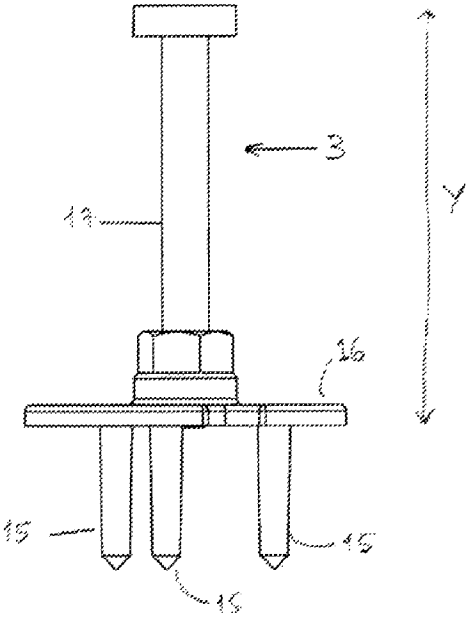
FIG. 7 shows a side view of a distancing element 3.

For further minimisation of such rotational movement, and in particular rotational movement that might lead to movement of the lower end of the panel towards the wall, it is possible to use distancing element 3 as shown in FIGS. 7 and 8.

The distancing element 3 has tines 15 which can penetrate the acoustic panel. These tines 15 extend from a flange 16 which limits penetration into the acoustic panel. Extending from the opposed face of the flange 16 is a spacer bolt 17, which may be adjusted in length by rotation of the spacer bolt 17 relative to the nut 18 at the flange 16. In the suspension system of the invention the distance Y between the surface of the flange 16 which is in contact with the panel and the end of the spacer bolt which is distal from that corresponds with the distance X, such that the position on the acoustic panel into which the spacer element is added is held at the same distance from the wall as the position at which the panel bracket is affixed. This distance can be adjusted and optimised by modifying the length of the spacer bolt 17.

Figure 9:
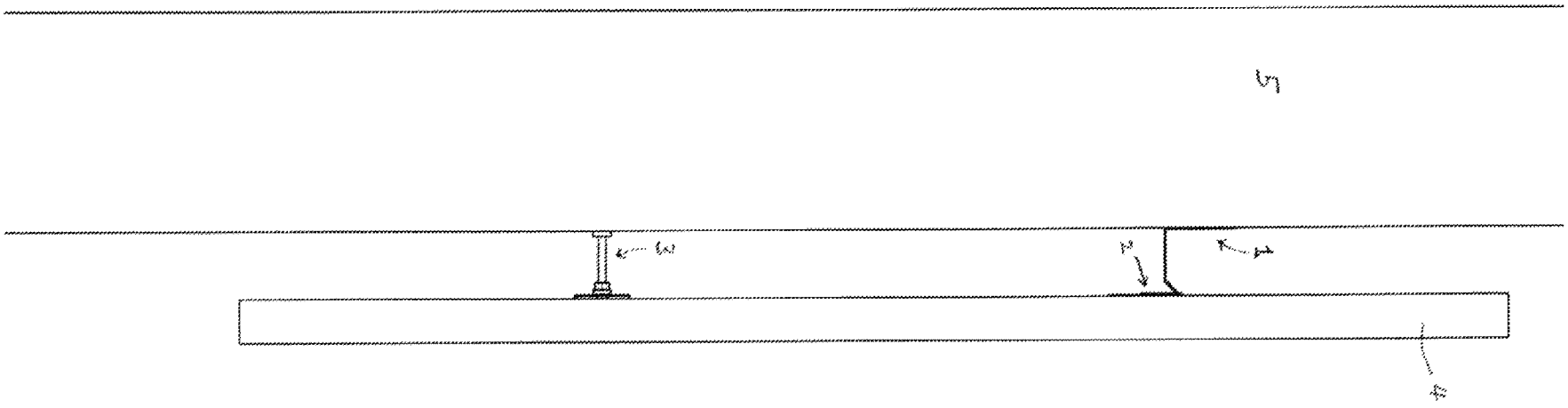
FIG. 9 shows a side view of an acoustic panel 4 mounted on a wall 5 using the wall bracket 1 shown in FIGS. 1 and 2, the panel bracket 2 shown in FIGS. 5 and 6 and the distancing element 3 shown in FIGS. 7 and 8.

FIG. 9 shows a mounted panel 4 in side view. Having been impaled on the barbs 12 of the panel bracket 2, the panel 4 is mounted to the wall 5 by hanging the panel bracket 2 on the previously-affixed wall bracket 1. The panel bracket 2 is affixed to the panel 4 in an upper region of the panel surface. The barbs 12 are inserted into the surface of the panel to the maximum extent possible, and so that the barb plate 13 lies against the surface of the panel and is contiguous with it.

The wall bracket 1 is affixed to the wall 5 by means of the fixing plate 6 being fastened to the wall 5 by means of fasteners (not shown) so that the fixing plate 6 lies along the surface of the wall 5. It can be seen that the wall bracket 1 as a whole is arranged substantially horizontally along the wall 5. As a result the panel bracket 2 is also arranged substantially horizontally along the wall 5.

In a lower region a distancing element 3 is applied to the panel 4 by means of inserting into the panel, on the same surface as the surface into which the panel bracket is inserted, the tines 15. The distancing element is pressed into the surface of the panel as far as possible so that the surface of the flange 16 rests against the surface of the panel and is generally contiguous with it.

Application of the distancing element 3 to the panel 4 takes place prior to application of the panel bracket 2 on to the affixed wall bracket 1. This means that the application of the panel 4 to the wall 5 is a straightforward matter of hanging the panel bracket 2 on to the wall bracket 1.

The end of the spacer bolt 17 that is distal from the flange then bears against the wall 5. This prevents rotation of the lower part of the panel towards the wall 5 and maintains the distance X between the panel 4 and the wall 5 in the lower region also. The precise length of the spacer bolt 17 can be adjusted by turning the bolt 18.

Figure 10:
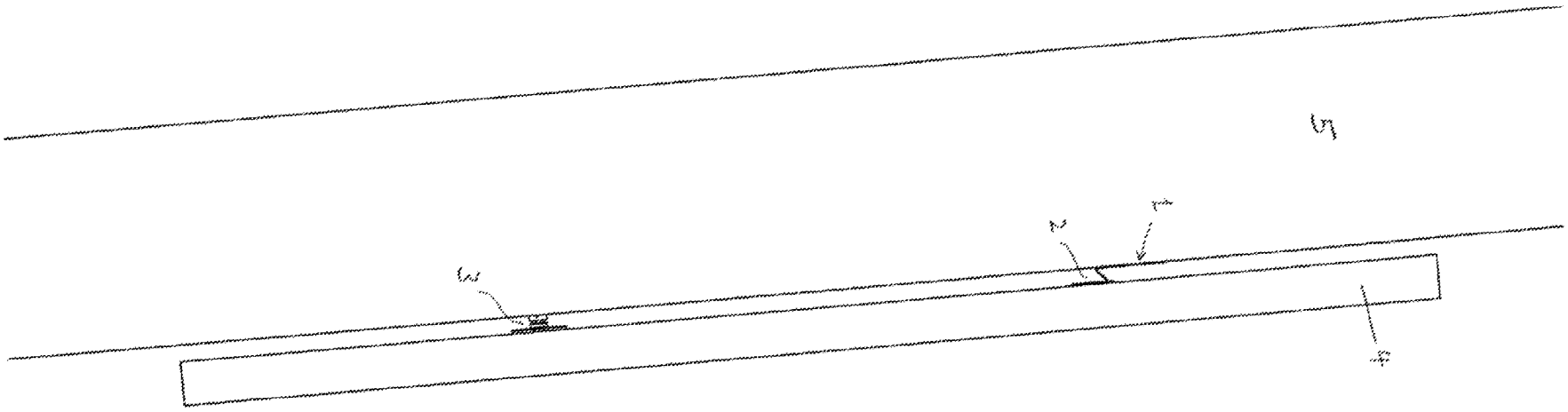
FIG. 10 shows an acoustic panel 4 mounted on a wall 5 using the wall bracket 1 shown in FIGS. 3 and 4, the panel bracket 2 shown in FIGS. 5 and 6 and the distancing element 3 shown in FIGS. 7 and 8.

FIG. 10 shows a mounted panel 4 in side view in the same way as in FIG. 9, with the difference that the wall bracket used is that shown in FIGS. 3 and 4. As a result, the distance X between the panel 4 and the wall 5 is smaller than in the arrangement shown in FIG. 9.

Figure 11:
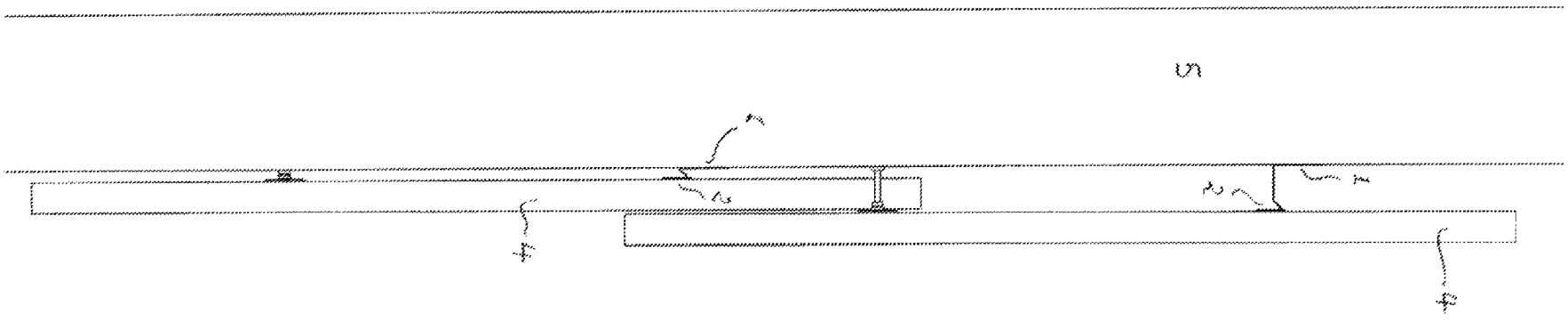
FIG. 11 shows 2 acoustic panels 4 mounted on a wall 5, one being mounted using the wall bracket 1 shown in FIGS. 1 and 2 and the panel bracket 2 shown in FIGS. 5 and 6, and the other being mounted using the wall bracket 1 shown in FIGS. 3 and 4 and the panel bracket 2 shown in FIGS. 5 and 6.

FIG. 11 shows two panels **4*u* and 41 mounted to a single wall 5. The upper panel 4*u* is mounted as described in FIG. 9 and the lower panel 4*l* is mounted as described in FIG. 10, partially underneath the panel 4*u***. In this example the distance Xu between the upper panel and the wall is 65 mm and the distance XI between the lower panel and the wall is 15 mm. As a result, it is possible to overlap the panels.

Figure 12:
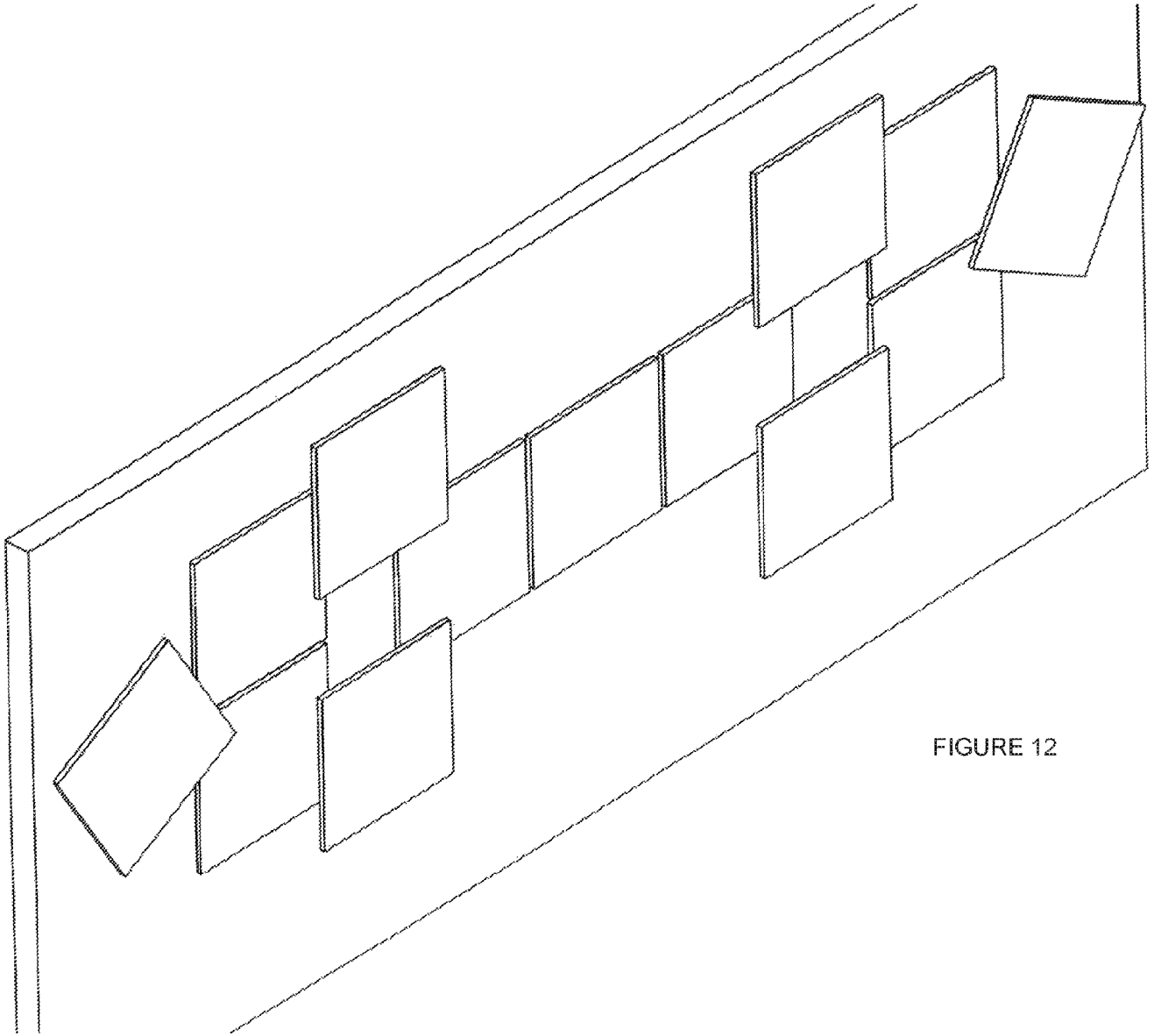
FIG. 12 shows a perspective view of multiple acoustic panels 4 mounted on a wall 5.

Overlapping is shown in perspective view in FIG. 12. As can be seen in FIG. 12 multiple panels may be arranged in any suitable pattern on the wall, including rotated as illustrated by the first and last panel shown. For a rotated panel the wall bracket would still be horizontal (namely, its long edges extend horizontally along the wall). The panel bracket would also be horizontal (namely, parallel with the wall bracket). Whereas the panels would be rotated in relation to the panel bracket, so the panel bracket is not parallel to the edges of the panel. It is an advantage of the invention that the same structure of wall bracket and panel bracket allows affixation of multiple panels at a variety of heights on the wall surface and at whichever angle is chosen by the installer.

Dimensions for the panels in this example are:

Square: 1160×1160×40 mm

Rectangle: 1760×1160×40 mm

Circles: Diameter 800 and 1160×40 mm

Triangle: 1160×1160×40 mm

XL panel: 2360×1160×40 mm

The invention claimed is:

1. A sound absorbing system comprising:

(a) a wall;

(b) a wall bracket that is affixed to the wall, the wall bracket comprising:

(i) a fixing plate which is affixed to and lies along the wall;

(ii) a spacer element connected to and projecting from the fixing plate so as to extend away from the wall;

(iii) a support element connected to the spacer element;

(c) a panel bracket which is a unitary component comprising:

(iv) a hook element arranged to hang on the support element of the wall bracket; and (v) at least one barb integrally formed with the hook element and extending away from the wall;

(d) an acoustic panel affixed to the panel bracket by means of the at least one barb penetrating the panel;

such that the acoustic panel is positioned spaced away from the wall at a distance X from the wall and generally parallel to the wall.

2. A system according to claim 1 in which at least two of said acoustic panels are attached to the wall, each acoustic panel being affixed by means of one of said wall bracket and one of said panel bracket.

3. A system according to claim 2 in which the two panels are positioned at different distances X from the wall, and preferably overlap.

4. A system according to claim 1 in which the wall bracket is a unitary component.

5. A system according to claim 1 in which the panel bracket is a unitary component.

6. A system according to claim 1 in which the spacer element is in the form of a plate which is substantially coextensive with the fixing plate.

7. A system according to claim 1 in which the spacer element extends from the fixing plate in a direction such that it is substantially perpendicular to the wall.

8. A system according to claim 1 in which the support element is a plate which extends upwardly from an edge of the spacer element that is distal from the wall, and which is substantially coextensive in length with the spacer element.

9. A system according to claim 8 in which the support element is a plate folded to provide a ridge which constitutes the uppermost point of the support element, on which the hook element of the panel bracket rests.

10. A system according to claim 1 in which the hook element is in the form of a single folded hook plate that has a length shorter than the length of the support element by an amount in the range 10 to 40 mm.

11. A system according to claim 1 in which the support element comprises two ends, a stop member at each end, and in which the hook element fits between the two stop members.

12. A system according to claim 1 in which the hook element is configured so that when installed it will provide a barb plate whose plane is substantially vertical and from which extends the at least one barb.

13. A system according to claim 12 in which substantially the full length of each barb is within the panel material and the barb plate lies along and is generally contiguous with the surface of the panel facing the wall.

14. A system according to claim 12 in which the wall bracket also includes a stabilisation member that extends downwardly from an edge of the spacer element that is distal from the wall and is in the form of a plate and is substantially parallel to the wall, such that the barb plate bears against the stabilization element.

15. A system according to claim 1 in which the at least one barb extends from the hook element upwardly such that the angle between the plane of each barb and the wall is in the range 20 to 50 degrees.

16. A system according to claim 1 in which the wall bracket is generally elongate and is positioned on the wall so as to be substantially horizontal.

17. A method of mounting an acoustic panel on a wall, the method comprising:

providing a wall bracket comprising a fixing plate which has at least two apertures; a spacer element connected to and projecting from the fixing plate;

and a support element connected to the spacer element;

affixing the wall bracket to the wall by means of fasteners which pass through the apertures, such that the fixing plate lies along the wall and the spacer element extends in a direction away from the wall;

providing an acoustic panel;

providing a panel bracket which is a unitary component comprising a hook element and at least one barb integrally formed with the hook element;

affixing the acoustic panel to the panel bracket by penetration of the at least one barb into the material of the acoustic panel;

hanging the panel bracket with the acoustic panel affixed thereto on the support element of the wall bracket by means of hanging the hook element on the support element.

18. A bracket for mounting an acoustic panel, the bracket comprising:

an elongate plate having first and second major surfaces and being of substantially rectangular perimeter having top and bottom long edges and short end edges;

wherein the top and bottom long edges have length in the range 250 to 600 mm;

and the top and bottom long edges have length from 3 to 10 times the length of the end edges;

wherein the top edge is provided with a fold along substantially its entire length in the direction of the first major surface;

and the plate is provided with at least two barbs in the form of cut-outs extending upwardly in a direction away from the second major surface and forming an angle with the second major surface in the range 20 to 50 degrees.

19. A system according to claim 1 in which the at least one barb is in the form of a cut-out in the hook element.

* * * * *